US007371056B2

(12) United States Patent
Ito et al.

(10) Patent No.: US 7,371,056 B2
(45) Date of Patent: May 13, 2008

(54) FLUID PUMP, COOLING SYSTEM AND ELECTRICAL APPLIANCE

(75) Inventors: Kenichi Ito, Zama (JP); Katsuya Seko, Yokohama (JP); Kentaro Tomioka, Sayama (JP); Tomonao Takamatsu, Tokyo (JP); Fumihide Nagashima, Yokohama (JP); Takahiro Kojima, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 292 days.

(21) Appl. No.: 11/093,030

(22) Filed: Mar. 30, 2005

(65) Prior Publication Data

US 2005/0249609 A1 Nov. 10, 2005

(30) Foreign Application Priority Data

Mar. 31, 2004 (JP) ..... 2004-107158
Aug. 25, 2004 (JP) ..... 2004-245164

(51) Int. Cl.
*F04B 17/00* (2006.01)
*F04B 35/04* (2006.01)

(52) U.S. Cl. ..... 417/353; 417/352; 417/410.1; 417/420; 417/423.1; 361/695; 361/696; 361/698; 361/699

(58) Field of Classification Search ..... 361/695, 361/699, 696, 698; 417/352, 353, 410.1, 417/420, 423.1
See application file for complete search history.

(56) References Cited

U.S. PATENT DOCUMENTS 7,124,775 B2 * 10/2006 Chang ..... 137/559
2003/0188765 A1 * 10/2003 Christenson et al. ..... 134/3
2003/0214786 A1 * 11/2003 Niwatsukino et al. ..... 361/699
2004/0025604 A1 * 2/2004 Call et al. ..... 73/863.22
2004/0042176 A1 * 3/2004 Niwatsukino et al. ..... 361/699
2004/0050533 A1 * 3/2004 Chesser et al. ..... 165/46

FOREIGN PATENT DOCUMENTS

JP 2003-124671 4/2003
JP 2003-161284 6/2003
JP 2003-172286 6/2003
JP 2003172287 A * 6/2003

* cited by examiner

*Primary Examiner*—Devon C. Karmer
*Assistant Examiner*—Leonard J Weinstein
(74) *Attorney, Agent, or Firm*—Pillsbury Winthrop Shaw Pittman, LLP

(57) ABSTRACT

A fluid pump includes a case including a pump chamber, a reserve tank for storing spare liquid and located in the case but outside the pump chamber and formed so that a space independent of the pump chamber is defined by the reserve tank, a fluid path forming member arranged inside the reserve tank and including a discharge path communicating between a discharge port and the pump chamber, and a communication hole which is formed in a side of the fluid path forming member so as to assume such a position that the communication hole faces an inside of the reserve tank so that the hole communicates between the discharge path and the inside of the reserve tank, the communication hole being sized so that air in the pump chamber is allowed to flow through the hole into the reserve tank.

26 Claims, 14 Drawing Sheets

FLUID PUMP, COOLING SYSTEM AND ELECTRICAL APPLIANCE

CROSS REFERENCE TO RELATED APPLICATIONS

This application claims the benefit of priority of Japanese Patent Application No. 2004-107158, filed in Japan on Mar. 31, 2004 and Japanese Patent Application No. 2004-245164 filed in Japan on Aug. 25, 2004. The entire contents of each of these applications are incorporated herein by reference.

BACKGROUND OF THE INVENTION

1. Field of the Invention

The present invention relates to a fluid pump suitable for a cooling system that cools heat generating parts.

2. Description of the Related Art

Conventionally many existing fluid pumps for handling a liquid are provided with a motor having a rotor to which an impeller is integrally fixed for rotation together with the rotor, so that the pump vanes of the impeller serve to suction the liquid into a pump chamber via a suction port, and to discharge the liquid out of the pump chamber via a discharge port.

Such pumps can be incorporated in a cooling system that cools heat-generating parts, including a heat-receiving section that absorbs the heat of the heat-generating parts via a liquid refrigerant and a heat-dissipating section that dissipates the heat transferred to the liquid refrigerant, as a means of circulating the liquid refrigerant through the heat-receiving section and the heat-dissipating section. When the liquid refrigerant is circulated through a closed circuit, the cooling system further includes a reserve tank for storing reserve liquid refrigerant to compensate for a decrease in the liquid refrigerant due to evaporation, in addition to the heat-receiving section, heat-dissipating section and fluid pump, as disclosed in Japanese Published Unexamined Patent Application No. 2003-172286, Japanese Published Unexamined Patent Application No. 2003-161284, and Japanese Published Unexamined Patent Application No. 2003-124671 for example. A purpose of employing the reserve tank is to prevent degradation of the cooling performance, since a decrease in the amount of the liquid refrigerant by evaporation results in a lower cooling capacity.

In such a conventional cooling system including a fluid pump, however, the separately installed reserve tank incurs various drawbacks such as an increase in the number of parts as well as in over-all dimensions of the system, and also in the number of connecting points.

SUMMARY OF THE INVENTION

Therefore, an object of the present invention is to provide a fluid pump that can also serve as a reserve tank, and can hence eliminate the need of an additional reserve tank, thus to avoid an increase in the number of parts.

The present invention provides a pump comprising a case including a pump chamber for storing a liquid, a suction port and a discharge port provided on the case so as to communicate with the pump chamber, an impeller having pump vanes and rotatably placed in the pump chamber, which suctions a liquid into the pump chamber via the suction port and discharges the liquid out of the pump chamber via the discharge port by rotation, a motor for driving the impeller, installed in the case and having a stator and a rotor to which the impeller is integrally attached for rotating together, a reserve tank provided for storing spare liquid and located in the case but outside the pump chamber and formed so that a space independent of the pump chamber is defined by the reserve tank, a fluid path forming member arranged inside the reserve tank, including a discharge path communicating between the discharge port and the pump chamber, the fluid path forming member having a side, a communication hole which is formed in the side of the fluid path forming member so as to assume such a position that the communication hole faces an inside of the reserve thank of the fluid path forming member so that the communication hole communicates between the discharge path and the inside of the reserve tank, the communication hole being sized so that air in the pump chamber is allowed to flow therethrough into the reserve tank.

Since the fluid pump thus constructed includes a reserve tank inside the case, the fluid pump can provide a function of a reserve tank and thus eliminate the need to install an additional reserve tank.

BRIEF DESCRIPTION OF THE DRAWINGS

Other objects, features and advantages of the present invention will become clear upon reviewing the following description of the embodiment with reference to the accompanying drawings, in which.

DETAILED DESCRIPTION OF THE INVENTION

Figure 1:
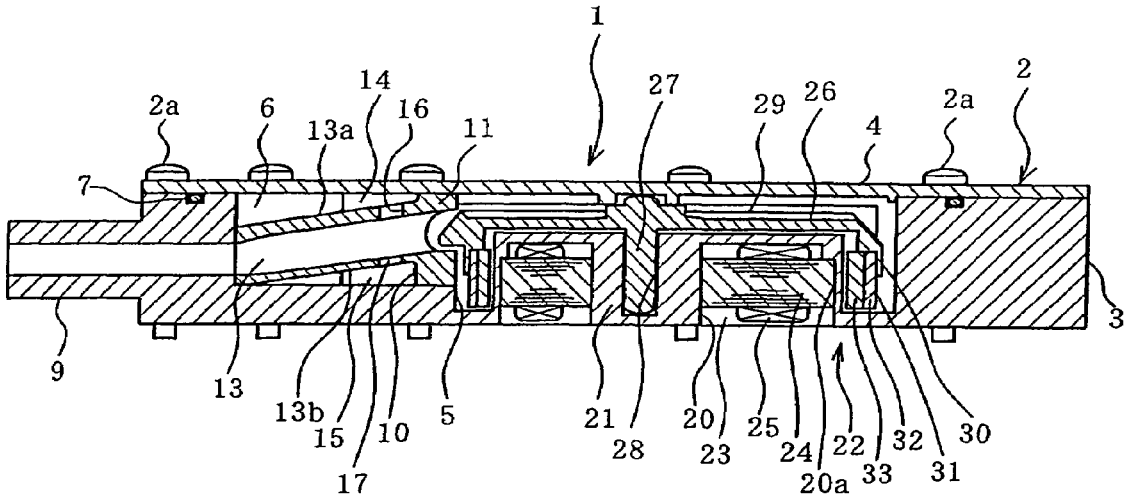
FIG. 1 is a longitudinal sectional view taken along the line 1-1 of FIG. 2, showing a fluid pump according to a first embodiment of the present invention.
Figure 2:
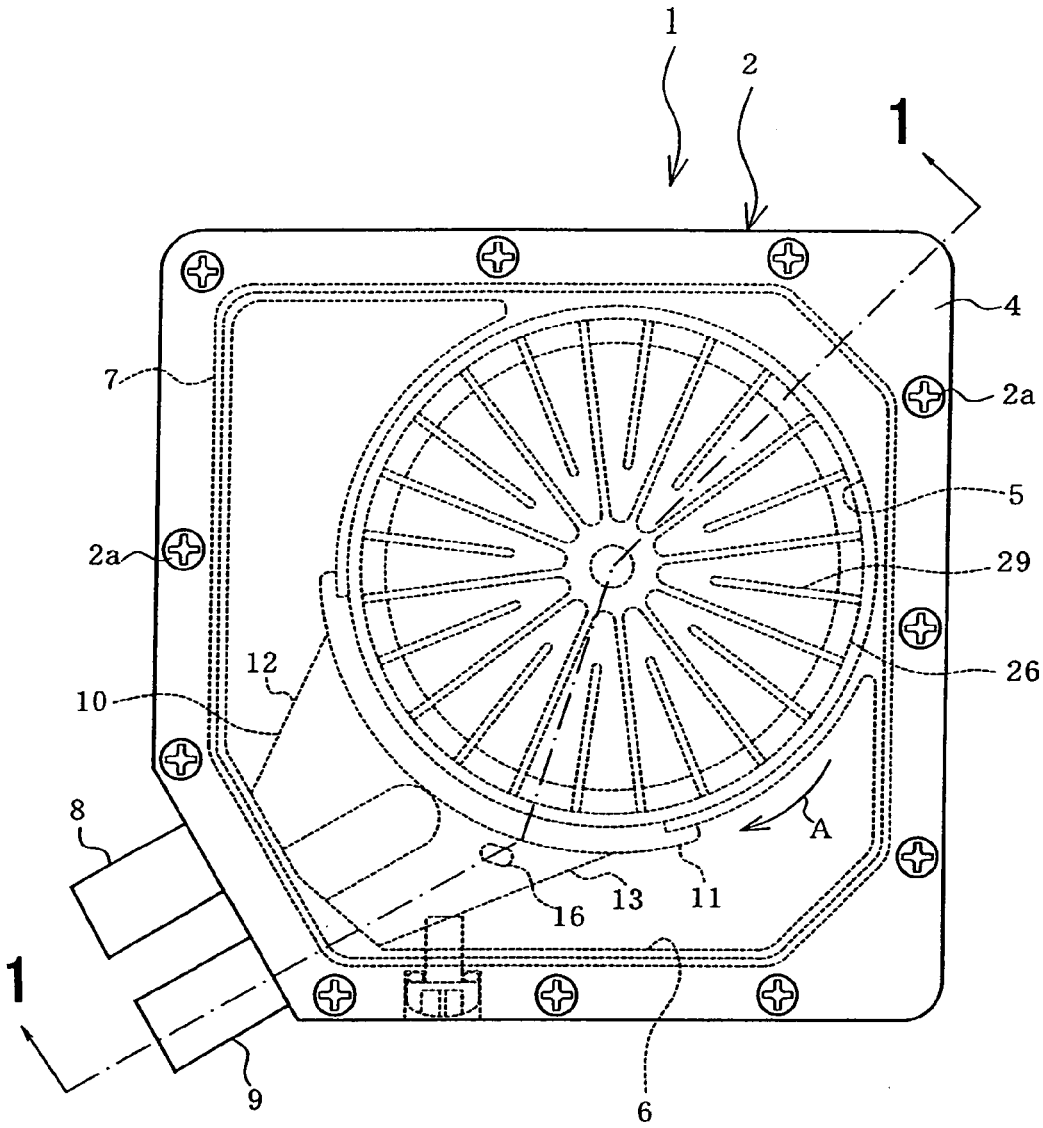
FIG. 2 is a plan view of the fluid pump.
Figure 3:
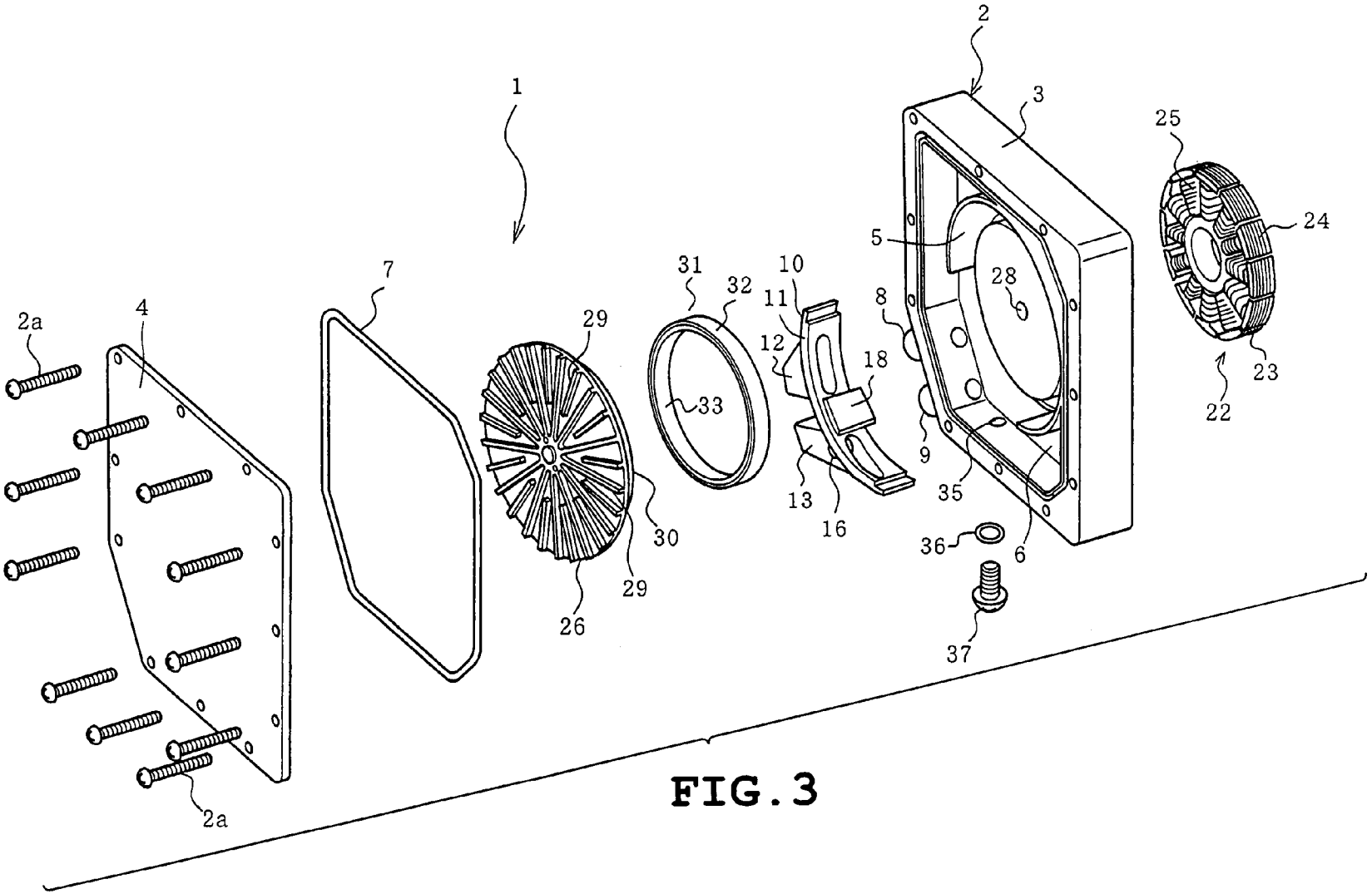
FIG. 3 is an exploded perspective view showing the fluid pump.
Figure 4:
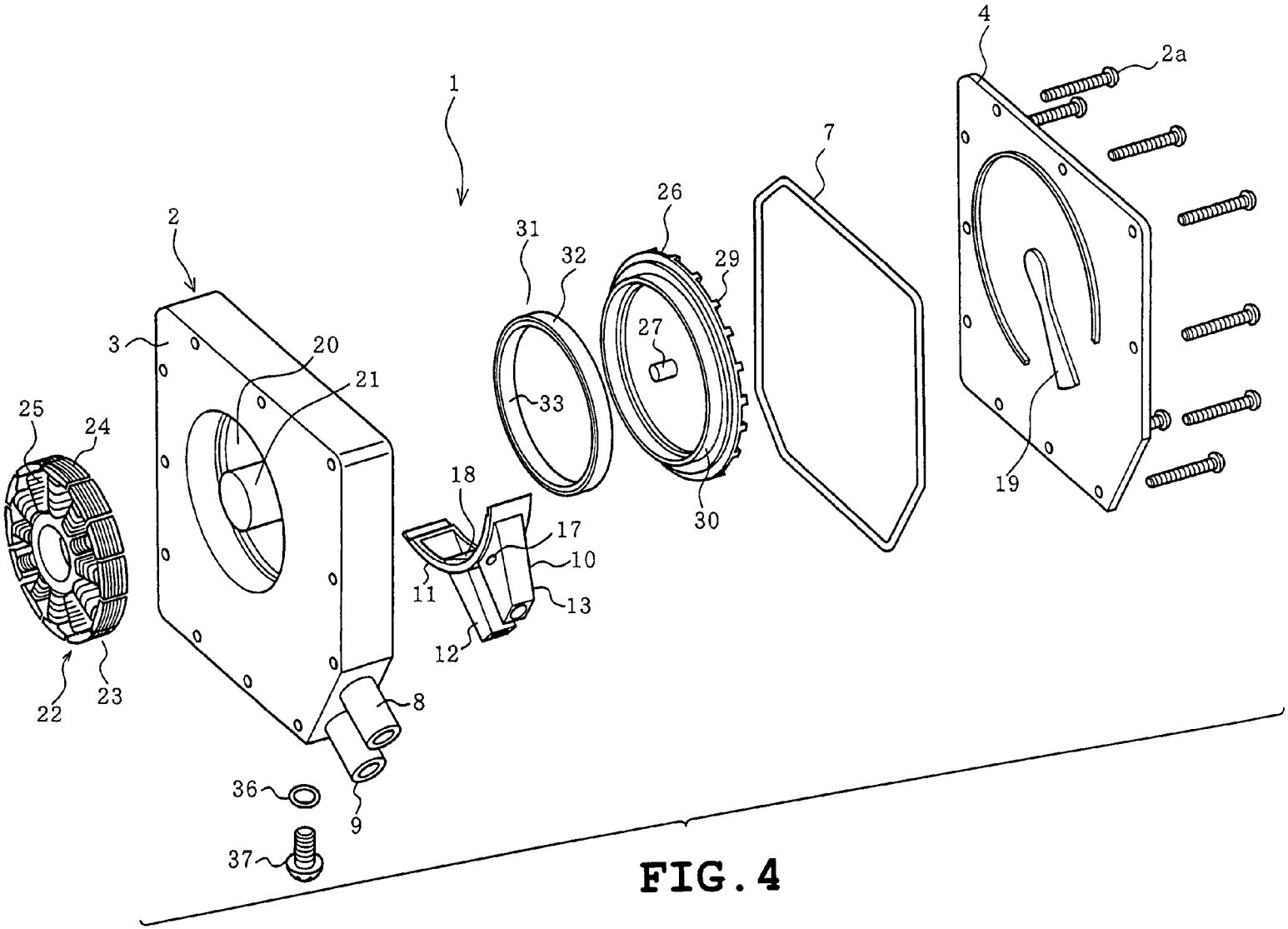
FIG. 4 is an exploded perspective view showing the fluid pump viewed from an opposite direction from FIG. 3 (case body 3 side)

Referring to FIG. 1 through FIG. 8, a first embodiment of the present invention will be described hereunder. FIG. 2 is a plan view showing a fluid pump 1 according to the present invention, while FIG. 1 is a cross sectional view taken along the line 1-1 of FIG. 2, FIG. 3 is an exploded perspective view and FIG. 4 is an exploded perspective view viewed from an opposite direction from FIG. 3, respectively showing the same fluid pump.

As shown in FIGS. 1 to 4, a case 2 of the fluid pump 1 is of a generally rectangular shape, and includes a case body 3 and a cover 4 attached thereto with a plurality of screws 2*a*. The case body 3 includes a circular recessed portion with an opening on the side of the cover 4 to concurrently constitute a pump chamber 5, and another similar recess with an opening on the side of the cover 4 that constitutes a reserve tank 6. The opening of the pump chamber 5 and the reserve tank 6 are closed by the cover 4. Between the case body 3 and the cover 4, a sealing member 7 such as an O-ring is air-tightly interposed so as to surround the pump chamber 5 and the reserve tank 6. The case body 3 is provided with a cylindrically shaped suction port 8 and discharge port 9 integrally formed on an outer peripheral portion thereof. The suction port 8 and discharge port 9 are disposed substantially parallel to each other so as to laterally project from the case body, and have an opening on the side of the reserve tank 6.

Figure 5:
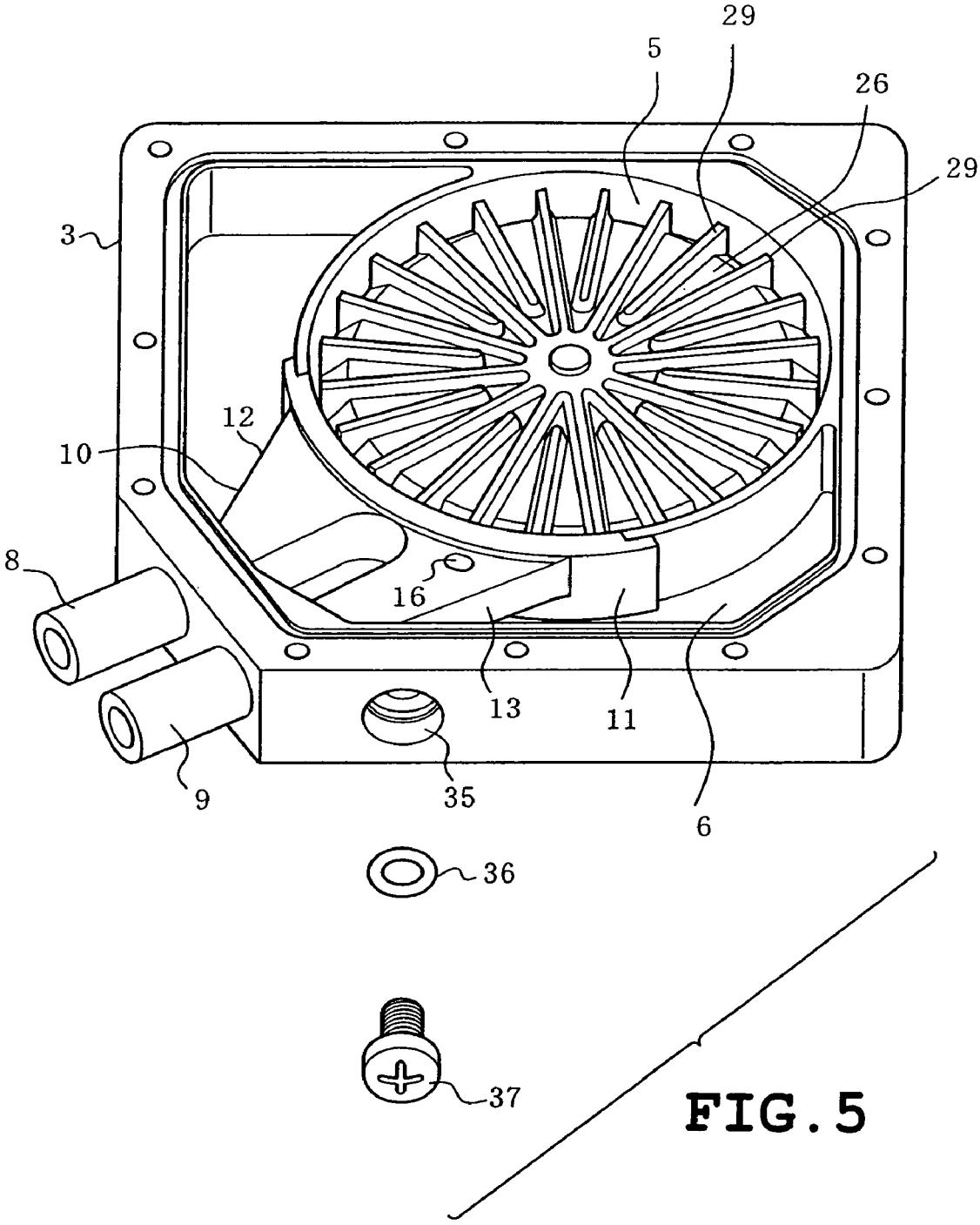
FIG. 5 is a perspective view showing a major part of the fluid pump with its cover removed.
Figure 6:
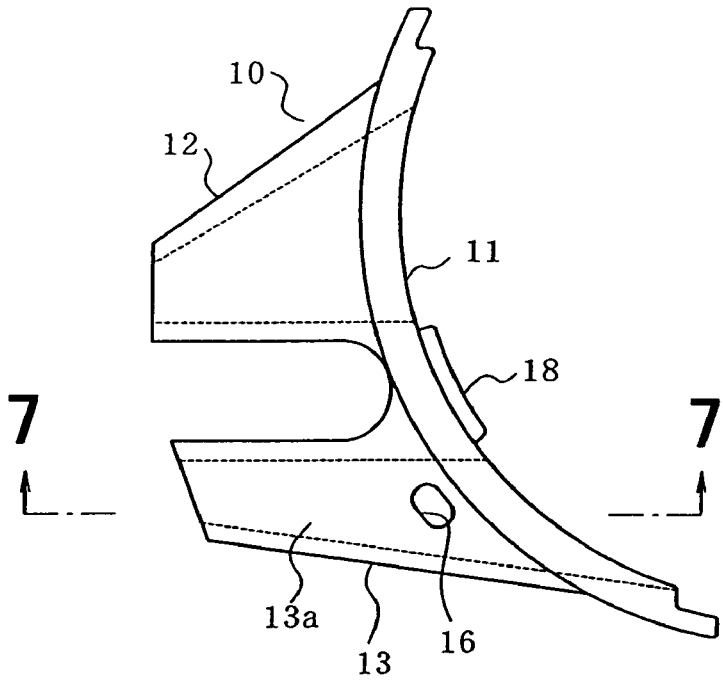
FIG. 6 is a plan view showing a fluid path forming member.

A portion of the reserve tank 6 is included in an area among the suction port 8, discharge port 9 and the pump chamber 5, where a fluid path forming member 10 (corresponding to the fluid path forming member), separately formed from the case body 3, is located. The fluid path forming member 10 includes an arc-shaped partition wall 11, a cylindrical suction path 12 to be engaged with the suction port 8 and a generally rectangular-cylindrically shaped discharge path 13 to be engaged with the discharge port 9, all of which are integrally formed, as shown in FIG. 5 and FIG. 6. Upon placing the fluid path forming member 10 in the reserve tank 6, the partition wall 11 divides the pump chamber 5 and the reserve tank 6, and the suction path 12 communicates between the suction port 8 and the pump chamber 5 while the discharge path 13 communicates between the pump chamber 5 and the discharge port 9.

Figure 7:
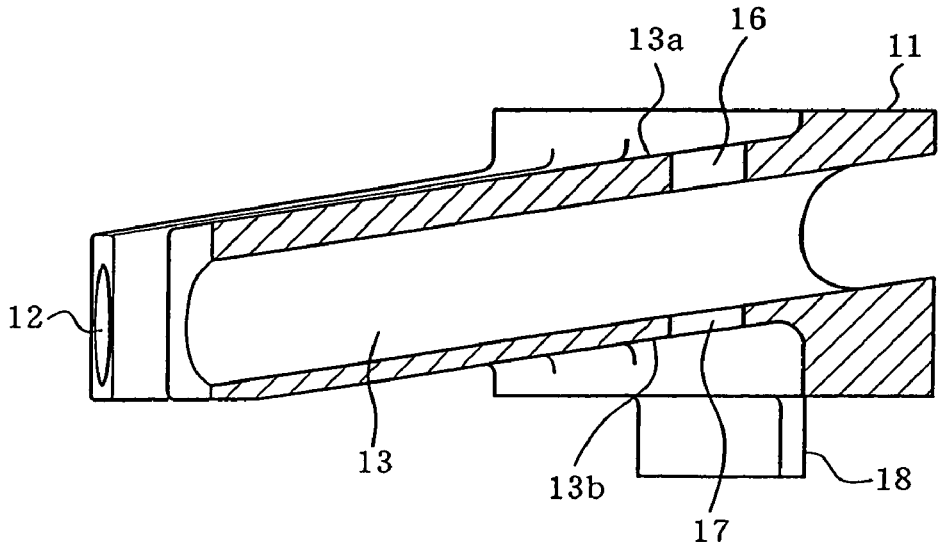
FIG. 7 is an enlarged cross-sectional view taken along the line 7-7 of FIG. 6.

The discharge path 13 is inclined inside the reserve tank 6 such that an end on the pump chamber side becomes higher than the other end, as shown in FIG. 1 (refer to FIG. 7). Between the cover 4 and an upper face 13*a* of the wall constituting the discharge path 13 as shown in FIG. 1, a gap 14 is provided, and likewise a gap 15 is provided between a lower face 13*b* of the discharge path 13 and a bottom face of the reserve tank 6 in the case body 3 as shown in FIG. 1. For communication between these gaps 14 and 15 (i.e. inside of the reserve tank 6) and inside of the discharge path 13, the discharge path 13 is provided with a communication hole 16 at a position close to the pump chamber 5 (the right side in FIG. 1) on the upper face 13*a*, and a communication hole 17 at a position close to the pump chamber 5 on the lower face 13*b*, respectively. In this case, accordingly, the communication holes 16 and 17 connecting the inside of the discharge path 13 and that of the reserve tank 6 are provided on a plurality of faces, specifically on two faces in this case (the upper face 13*a* and the lower face 13*b*), on the wall constituting the discharge path 13.

The fluid path forming member 10 is provided with a first pressure protrusion 18 on a face of the partition wall 11 facing the pump chamber 5 side in a region between the suction path 12 and the discharge path 13. A second pressure protrusion 19 is located on an inner face of the cover 4, so as to radially extend from a position corresponding to the center of the pump chamber 5.

The case body 3 is provided with a stator housing 20, which is a portion recessed toward the cover 4 with an opening facing the opposite side of the cover 4 (downward in FIG. 1), located in a central portion of the pump chamber 5. The stator housing 20 includes a stator mounting base 21 protruding from a central portion toward the opening thereof. In the stator housing 20, a motor 22 is installed with its stator 23 mounted on the stator mounting base 21. The stator 23 includes a stator core 24 having a plurality, specifically twelve pieces in this case, of teeth and coils 25 wound on the respective teeth.

In the pump chamber 5, a disc-shaped impeller 26 is rotatably installed. The axle 27 disposed at the center of the impeller 26 is rotatably supported by a bearing 28 located at a central portion of the stator housing 20. The impeller 26 includes a multitude of radially formed pump vanes 29 on a face thereof opposing the cover 4. When the impeller 26 rotates, the surface of the pump vanes 29 facing the cover 4 confronts the second pressure protrusion 19, and an outer circumferential edge face of the pump vanes 29 confronts the first pressure protrusion 18.

The impeller 26 also includes a short cylindrical portion 30 on the face opposing the case body 3, and a rotor 31 of the motor 22 is disposed along an inner circumferential surface of the cylindrical portion 30. The rotor 31 includes a short cylindrical rotor yoke 32 and a short cylindrical rotor magnet 33 located along an inner circumferential surface of the rotor yoke 32, such that an inner circumferential surface of the rotor magnet 33 is opposing an outer periphery of the teeth of the stator 23, via a peripheral wall 20*a* of the stator housing 20. The rotor magnet 33 is magnetized in 8 poles, for example.

Accordingly, the rotor 31 and the stator 23 constitute an outer-rotor type motor 22 which drives impeller 26, so that when the rotor 31 rotates the impeller 26 also rotates together with the rotor 31. The motor 22 can be rotated in both forward and backward directions. The opening of the stator housing 20 is closed with a cover (not shown).

Referring to FIG. 5, the case body 3 is provided with a liquid inlet 35 communicating in and outside of the reserve tank 6, so that a liquid can be introduced into the reserve tank 6 through the liquid inlet 35. The liquid inlet 35 is a circular recess, and can be tightly closed via a screw 37 via an O-ring 36 which serves as a sealing means. That is the structure of the fluid pump 1.

Figure 8:
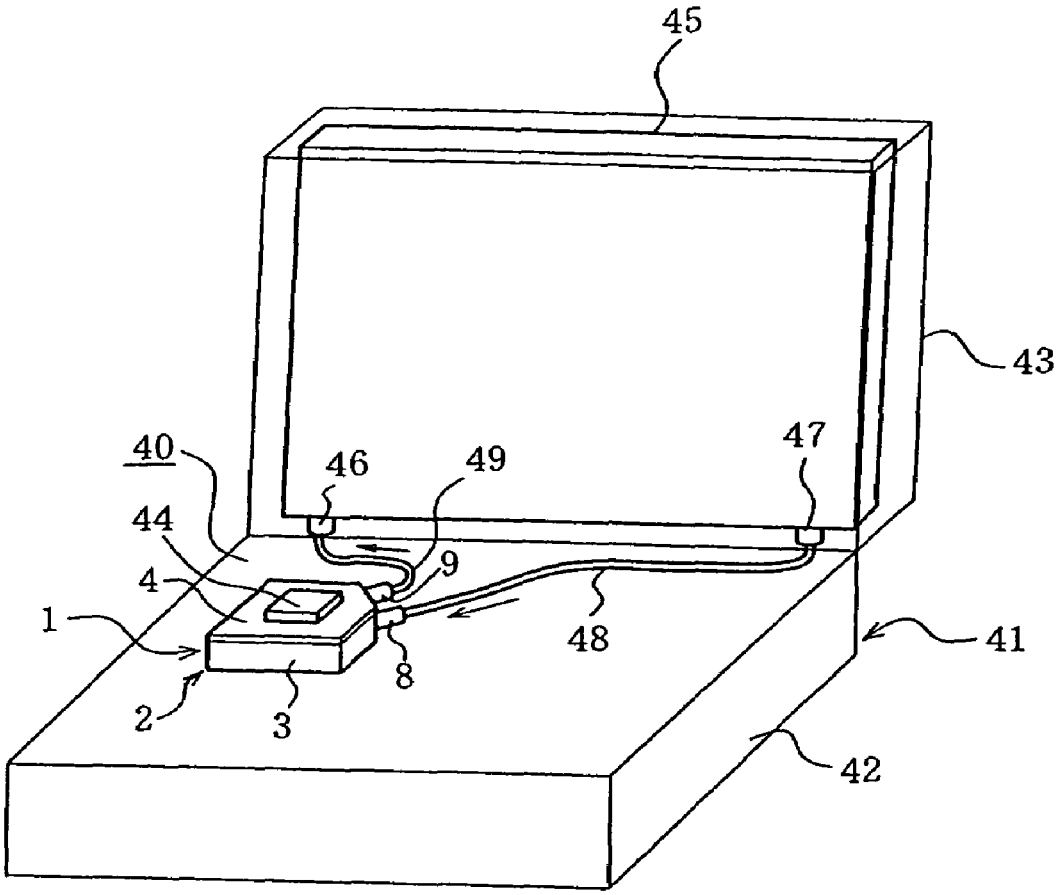
FIG. 8 is a schematic perspective view showing a personal computer in which a cooling system is incorporated.

Now, FIG. 8 is a schematic perspective view showing a laptop personal computer 41 in which a cooling system 40 including the fluid pump 1 is employed as an electrical appliance. The personal computer 41 includes a case 42 and a case cover 43 pivotally attached to the case 42 so as to open or close the case 42. The case 42 is provided with a keyboard (not shown) on the upper face thereof, and the case cover 43 includes an LCD (not shown) on the inner face thereof.

The case 42 includes therein a CPU 44 which is a heat-generating component, disposed so as to contact the cover 4 of the fluid pump 1. Here, the fluid pump 1 is placed with the cover 4 facing upward. The cover 4 also serves as a heat-receiving section to absorb the heat of the CPU 44, and hence the fluid pump 1 integrally includes the heat-receiving section. The case cover 43 includes therein a heat-dissipating section 45, which includes a fluid path (not shown) that serves as a passage for a cooling liquid (liquid refrigerant), and also an inlet 46 and outlet 47 communicating with the fluid path. The suction port 8 of the fluid pump 1 is connected to the outlet 47 via a connection tube 48, while the discharge port 9 of the fluid pump 1 is connected to the inlet 46 via a connection tube 49. The liquid refrigerant is sealed in inside the pump chamber 5 and reserve tank 6 of the fluid pump 1, as well as in the fluid path of the heat-dissipating section 45. The fluid path through which a liquid flows is a closed circuit.

Under such a structure, controlling power supply to the coil 25 of the motor 22 in the fluid pump 1 causes the impeller 26 to rotate together with the rotor 31 in a direction of the arrow A in FIG. 2. This rotation causes a pumping effect of the pump vanes 29 of the impeller 26, so that the liquid in the heat-dissipating section 45 is suctioned into the pump chamber 5 through the suction port 8, and the liquid in the pump chamber 5 is discharged toward the connection tube 49 through the discharge port 9. The liquid discharged toward the connection tube 49 is sent to the fluid path in the heat-dissipating section 45.

During this process, the liquid flowing through the pump chamber 5 of the fluid pump 1 absorbs the heat generated by the CPU 44 via the cover 4, to thereby cool the CPU 44. The liquid that has removed the heat from the CPU 44 dissipates the heat at the heat-dissipating section 45, thus to be cooled. The cooled liquid is again suctioned into the pump chamber 5 of the fluid pump 1, and removes the heat generated by the CPU 44. In this way, the liquid flowing through the fluid pump 1 prevents the CPU 44 from being overheated.

In the cooling system 40 thus configured, the cooling liquid flowing through the circuit decreases due to evaporation and so on, which may allow intrusion of a bubble (air) in the liquid. However, since the fluid path forming member 10 is provided with a communication hole 16 located on the upper face 13*a* of the discharge path 13, the bubble escapes through the communication hole 16 toward the upper gap 14 (inside the reserve tank 6), when the liquid carrying the bubble passes through the discharge path 13. This also causes the liquid inside the reserve tank 6 to be supplemented into the discharge path 13 through the communication holes 16 and 17. Consequently, a decrease in quantity of the liquid circulating through the fluid path can be effectively restrained.

Also, when introducing the cooling liquid through the liquid inlet 35 in this embodiment, it is preferable to rotate the motor 22 for driving the impeller 26 in a reverse direction (opposite to the arrow A). This causes the communication holes 16 and 17 on the discharge path 13 to serve as a suction inlet, so as to inject therethrough the liquid inside the reserve tank 6 into the pump chamber 5. Consequently, the liquid can be efficiently introduced.

Further, since the discharge path 13 is also provided with the communication hole 17 on the lower face 13*b* according to this embodiment, when the fluid pump 1 is placed such that the lower face 13*b* of the discharge path 13 faces upward (i.e. with the cover 4 facing downward), the communication hole 17 serves as the hole for separating gas and liquid. Accordingly, the fluid pump 1 equally performs the gas-liquid separating function even when placed upside down, thereby offering broader versatility in use.

Still further, in the cooling system 40 according to this embodiment, the fluid pump 1 includes therein the reserve tank 6, which eliminates the need to additionally install a reserve tank. This allows avoiding an increase in the number of parts and keeping the cooling system 40 from becoming oversized, and, furthermore, decreasing the number of connection points.

Figure 9:
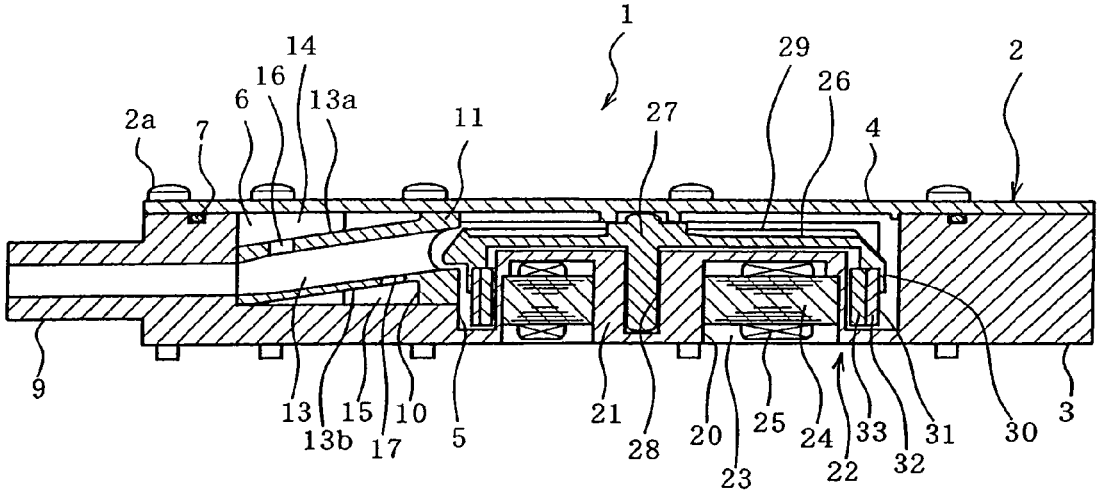
FIG. 9 is a longitudinal sectional view similar to FIG. 1, showing a fluid pump according to a second embodiment of the present invention.

FIG. 9 is a longitudinal sectional view showing a fluid pump according to a second embodiment of the present invention, which is different from the first embodiment in the following aspect.

Referring to the communication holes 16 and 17 provided on the discharge path 13 disposed with an inclination in the reserve tank 6, the communication hole 16 on the upper face 13*a* is located close to the discharge port 9 (the left side) in FIG. 9, while the communication hole 17 on the lower face 13*b* is located close to the pump chamber 5 (the right side in FIG. 9) as in the first embodiment. In other words, the upper and lower communication holes 16 and 17 are located at different positions along the extending direction of the discharge path 13.

In this case, the upper and lower communication holes 16 and 17 are shifted along the longitudinal direction of the discharge path 13 such that the both holes are located where the corresponding gaps 14 and 15 have a major height. Therefore, the bubble included in the liquid running through the discharge path 13 can more easily escape into the corresponding gaps 14 and 15 irrespective of which of the communication holes 16 and 17 is disposed to face upward.

Figure 10:
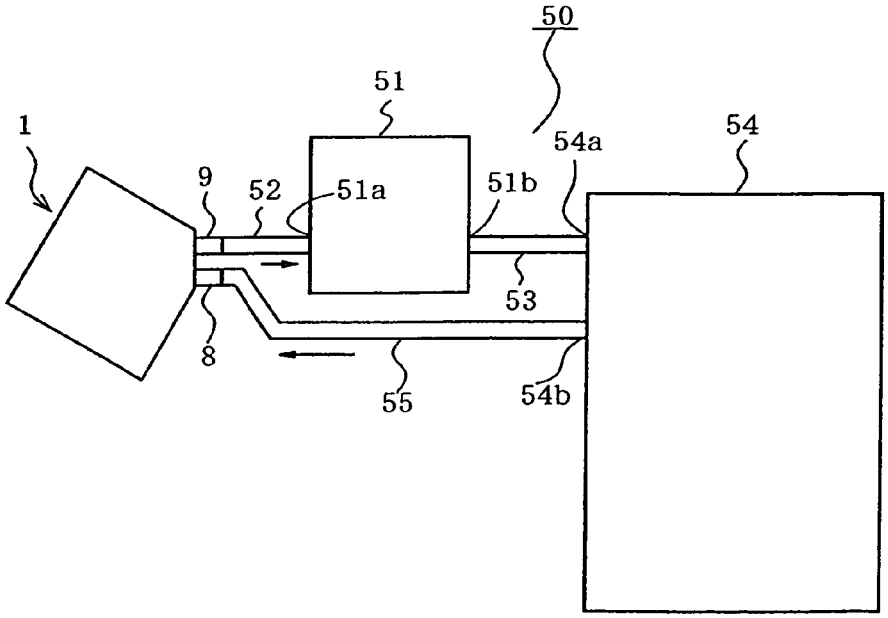
FIG. 10 is a block diagram showing a cooling system according to a third embodiment of the present invention.

FIG. 10 is a block diagram showing a cooling system according to a third embodiment of the present invention, which is different from the first embodiment in the following aspect.

In a cooling system 50, a heat-receiving section 51 is a separate unit from the fluid pump 1. The discharge port 9 of the fluid pump 1 is connected to an inlet 51*a* of the heat-receiving section 51 via a connection pipe 52, while an outlet 51*b* of the heat-receiving section 51 is connected to an inlet 54*a* of a heat-dissipating section 54 via a connection pipe 53. The suction port 8 of the fluid pump 1 is connected to an outlet 54*b* of the heat-dissipating section 54 via a connection pipe 55. In other words, the fluid pump 1, the heat receiving section 51 and the heat-dissipating section 54 are connected via the connection pipes 52, 53 and 55, so as to constitute a closed loop as a passage for the cooling liquid. By the heat-receiving section 51, a heat-generating component (not shown) is disposed in contact therewith.

Under the system thus configured, when the fluid pump 1 is activated, the liquid in the heat-dissipating section 54 is suctioned into the pump chamber 5 of the fluid pump 1 through the connection pipe 55, and the liquid in the pump chamber 5 is discharged toward the connection pipe 52 through the discharge port 9. The liquid discharged toward the connection pipe 52 passes through the heat-receiving section 51 and is sent to the heat-dissipating section 54 via the connection pipe 53.

During this process, the liquid flowing through the heat-receiving section 51 absorbs the heat of the heat-generating component, to thereby cool the same. The liquid that has removed the heat from the heat-generating component dissipates the heat at the heat-dissipating section 54, thus to be cooled. The cooled liquid is again suctioned into the pump chamber 5 of the fluid pump 1, and discharged to the heat-receiving section 51 to remove the heat of the heat-generating component again. In this way, the cooling liquid circulates and thereby prevents the heat-generating component from being overheated. In this case also, when a bubble is produced in the liquid flowing through the fluid pump 1, the bubble can escape into the reserve tank 6 through the communication holes 16 and 17 in the fluid pump 1, which causes the same amount of liquid as the bubble to be supplemented into the discharge path 13 out of the reserve tank 6.

In the cooling system 50 according to the third embodiment also, the fluid pump 1 includes therein the reserve tank 6, which eliminates the need to additionally install a reserve tank. This allows avoiding an increase in the number of parts and keeping the cooling system 50 from becoming oversized, and further decreasing the number of connection points.

Now FIGS. 11 through 15 show a cooling system according to a fourth embodiment of the present invention, which is different from the first embodiment in the following aspect.

Figure 12:
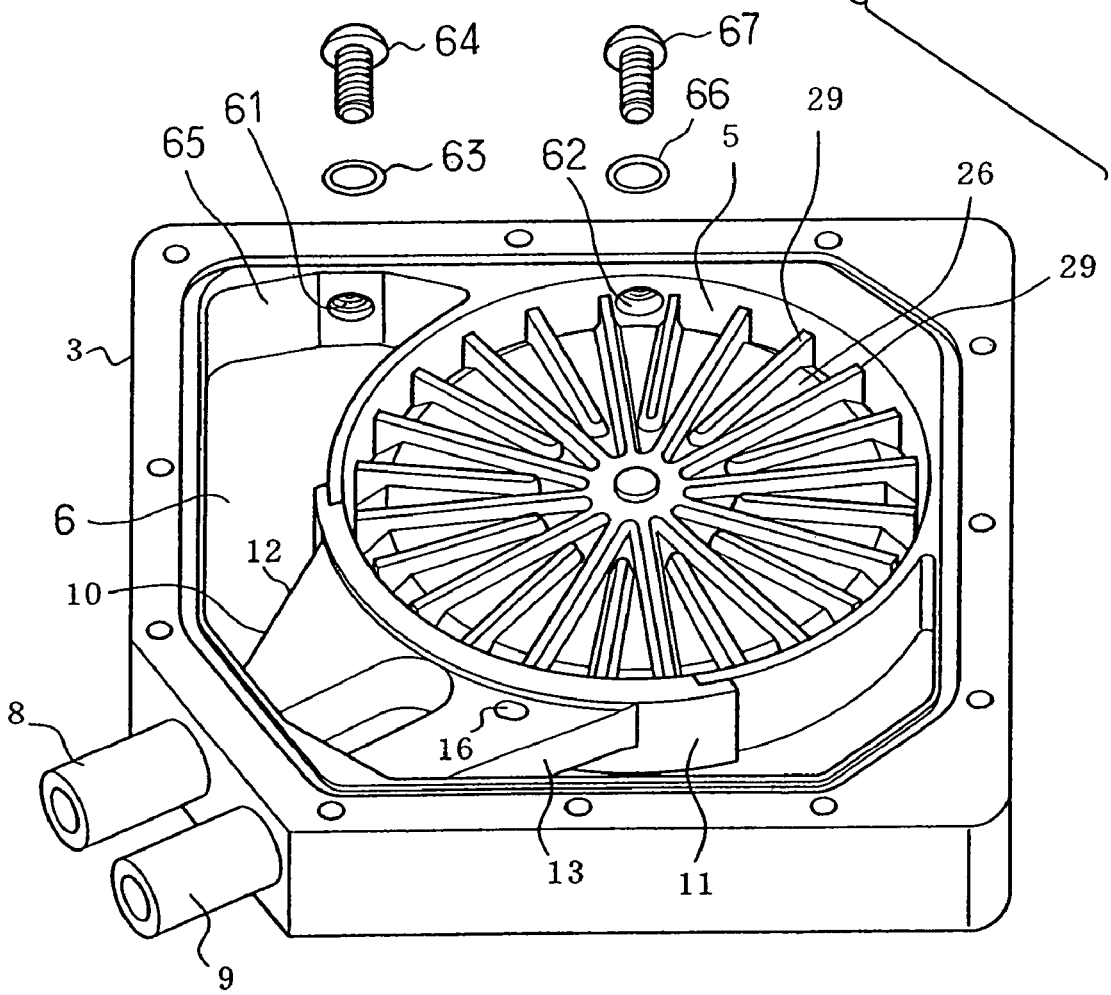
FIG. 12 is a similar view to FIG. 5.
Figure 13:
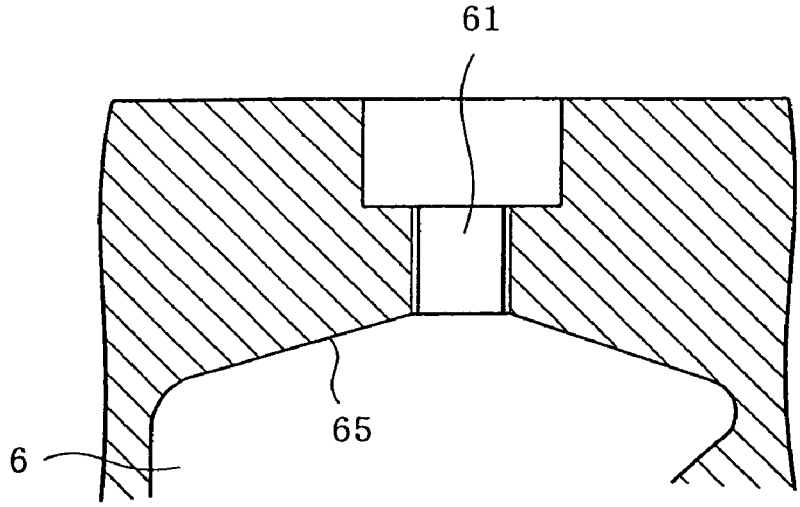
FIG. 13 is an enlarged cross-sectional view showing a portion around a first liquid inlet.

A fluid pump 60 is provided with a different number of liquid inlets at different positions from the fluid pump 1 of the first embodiment. Referring to FIG. 12, the case body 3 of the case 2 is provided with a first liquid inlet 61 communicating with the reserve tank 6 and a second liquid inlet 62 communicating with the pump chamber 5, which are located on a side wall on the upper face of the case body 3.

Figure 11:
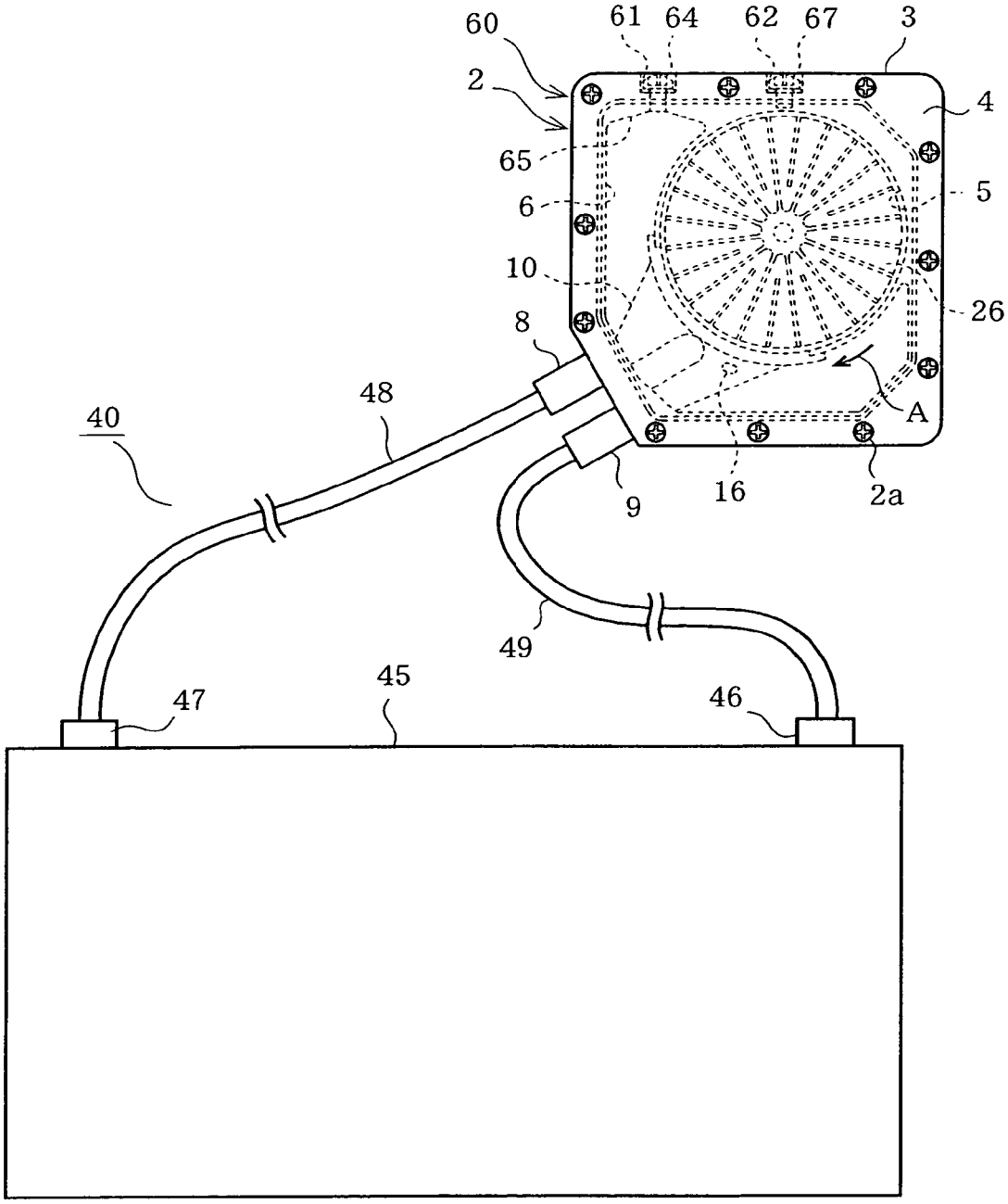
FIG. 11 is a schematic plan view showing a cooling system according to a fourth embodiment of the present invention.

The first liquid inlet 61 is provided so as to communicate in and outside (outside the case 2) of the reserve tank 6, and can be tightly closed via a screw 64 that serves as a sealing cap, via an O-ring 63 serving as a sealing means. As shown in FIG. 11, an upper inner wall 65 of the reserve tank 6 (more specifically the inner wall extending toward both sides of the first liquid inlet 61) is inclined upward toward the first liquid inlet 61, when the case 2 is oriented such that the first liquid inlet 61 is located at an upper position (refer to FIG. 13).

Figure 14:
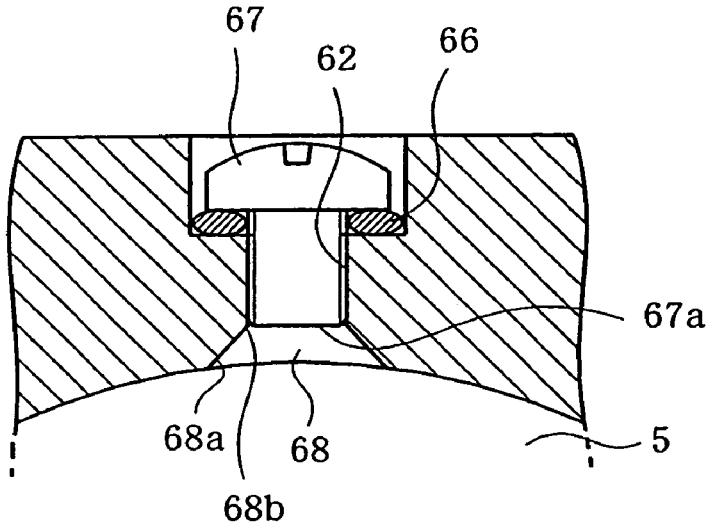
FIG. 14 is an enlarged cross-sectional view showing a portion around a second liquid inlet.

The second liquid inlet 62 is provided so as to communicate in and outside (outside the case 2) of the pump chamber 5, and can be tightly closed via a screw 67 that serves as a sealing cap, via an O-ring 66 serving as a sealing means. As shown in FIG. 14, when the screw 67 is attached in place, the tip portion 67*a* of the screw 67 directed toward the pump chamber 5 does not reach the pump chamber 5, and accordingly a liquid deposit 68 is defined between the tip portion 67*a* of the screw 67 and the pump chamber 5. The liquid deposit 68 is expanded in a trumpet shape toward the pump chamber 5, and hence an opening area S1 at the interface 68*a* with the pump chamber 5 is larger than an opening area S2 at the bottom portion 68*b* on the side of the screw 67 (S1>S2).

When incorporating the fluid pump 60 thus configured in the cooling system 40 as in the first embodiment, the suction port 8 of the fluid pump 60 is connected to the outlet 47 of the heat-dissipating section 45 via the connection tube 48, while the discharge port 9 is connected to the inlet 46 of the heat-dissipating section 45 via the connection tube 49, as shown in FIG. 11. The cooling system 40, upon being arranged as above, needs to receive a cooling liquid (liquid refrigerant) in its fluid path.

When introducing a cooling liquid into the fluid path of the cooling system 40, the fluid pump 60 is oriented such that the first and the second liquid inlets 61 and 62 are located at an upper position as shown in FIG. 11, and the sealing screws 64 and 67 are removed thus to open the first and the second liquid inlets 61 and 62. Then the cooling liquid is introduced through, for example, the first liquid inlet 61 on the side of the reserve tank 6. At this stage, it is preferable to rotate the fluid pump 60 in a reverse direction to a normal direction (opposite to the arrow A). This causes the liquid introduced into the reserve tank 6 to be efficiently introduced into the fluid path of the cooling system 40 via the communication holes 16 and 17. During such process, the majority of air in the fluid path is discharged outside the case 2 through the second liquid inlet 62 on the side of the pump chamber 5, while some portion of air ascends through inside of the reserve tank 6, to be discharged outside the case 2 via the first liquid inlet 61.

Also, since the liquid deposit 68 is provided above the pump chamber 5 close to the second liquid inlet 62 communicating with the pump chamber 5, the liquid flows more slowly in the liquid deposit 68, than a flow velocity of the liquid inside the pump chamber 5, when the impeller 26 is rotating. Accordingly, the air (bubble) in the liquid flowing in the pump chamber 5 becomes more apt to be discharged outward through the second liquid inlet 62, when passing by the liquid deposit 68. Further, since the upper inner wall 65 of the reserve tank 65 is inclined upward toward the first liquid inlet 61, the air inside the reserve tank 6 can be easily led thereto, thus to be discharged outward.

Figure 15:
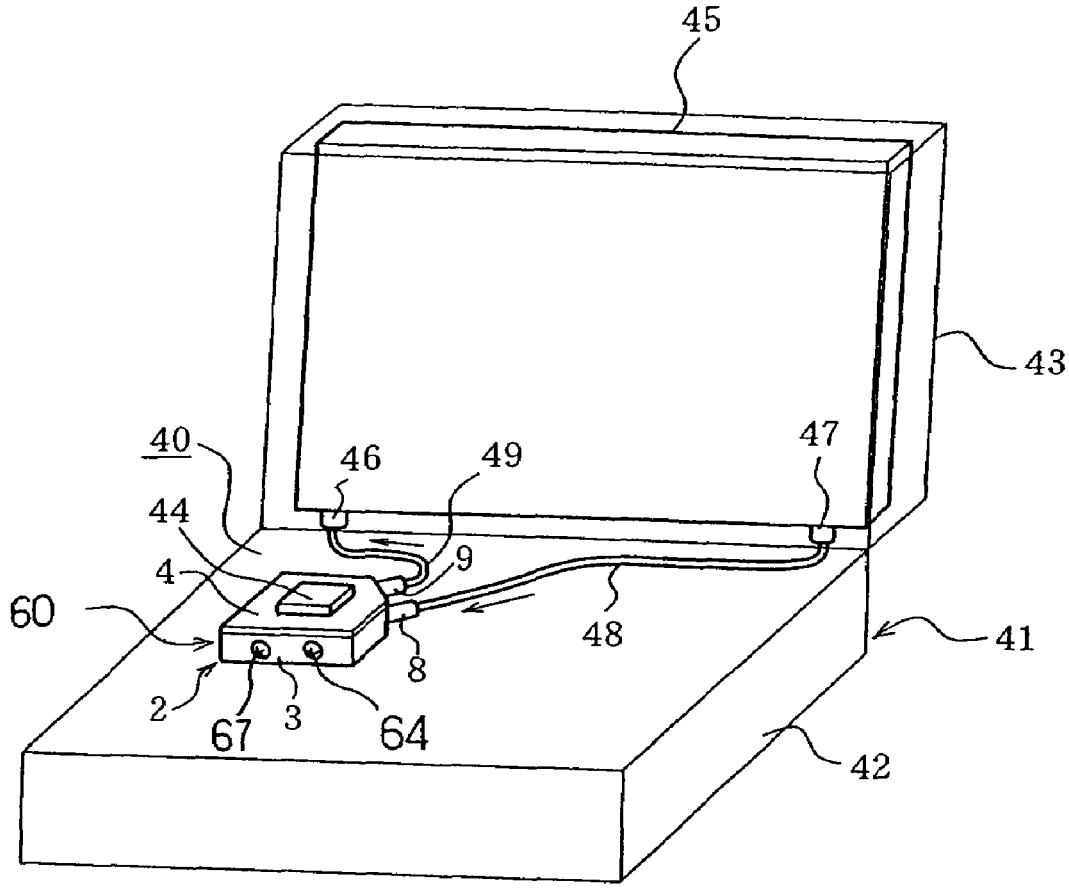
FIG. 15 is a similar view to FIG. 8.

Once the cooling liquid is filled in the fluid path of the cooling system 40 as described above, the first and the second liquid inlets 61 and 62 are tightly closed with the sealing screws 64 and 67 respectively. Then the cooling system 40 is incorporated in the personal computer 41 as shown in FIG. 15. In this case, the fluid pump 60 is disposed such that the cover 4, serving also as the heat-receiving section, faces upward as in the first embodiment, and the CPU 44 which is a heat-generating component is disposed in contact with the cover 4.

The arrangement as the fourth embodiment provides the following advantageous effects in particular. The case 2 of the fluid pump 60 is provided with the first liquid inlet 61 communicating with the inside of the reserve tank 6 and the second liquid inlet 62 communicating with the inside of the pump chamber 5. Accordingly, when introducing a liquid through the first liquid inlet 61, air remaining in the pump chamber 5 and in the fluid path communicating therewith can be efficiently discharged outward through the second liquid inlet 62 communicating with the pump chamber 5, and air present in the reserve tank 6 can be easily discharged outward through the first liquid inlet 61.

If, for example, only the first liquid inlet 61 were provided, without the second liquid inlet 62, the air remaining in the pump chamber 5 and in the fluid path communicating therewith would not be discharged until it is finally discharged through the first liquid inlet 61 after having been led into the reserve tank 6 through the communication holes 16 and 17.

On the other hand according to this embodiment, since the air remaining in the pump chamber 5 and in the fluid path communicating therewith can be efficiently discharged outward through the second liquid inlet 62 communicating with the pump chamber 5, the cooling liquid can be filled substantially in the entirety of the space for accommodating the liquid in the cooling system 40. Consequently, the reserve tank 6 for storing spare liquid can be made into the smallest possible dimensions, which allows reducing the size of not only the reserve tank but also the overall cooling system 40 including the reserve tank 6.

Also, the upper inner wall 65 of the reserve tank 6 is inclined upward toward the first liquid inlet 61 when the case 2 of the fluid pump 60 is oriented such that the first liquid inlet 61 is located at an upper position. Therefore, when introducing the liquid into the system, air present in the reserve tank 6 ascends inside the reserve tank 6 and is then led to the first liquid inlet 61 along the slope of the upper inner wall 65 of the reserve tank 6, thus to be discharged outward through the first liquid inlet 61. This allows the cooling liquid to be filled substantially in the entirety of the space in the reserve tank 6, and thereby reducing the size of not only the reserve tank but also the overall cooling system 40 including the reserve tank 6.

Also, since the liquid deposit 68 is provided between the pump chamber 5 and the tip portion 67*a* of the screw 67 for sealing the second liquid inlet 62 from the outside, the liquid flows more slowly in the liquid deposit 68, than a flow velocity of the liquid inside the pump chamber 5, when the impeller 26 inside the pump chamber 5 is rotating. Accordingly, the air (bubble) in the liquid flowing in the pump chamber 5 becomes more apt to be discharged outward through the second liquid inlet 62, when passing by the liquid deposit 68. Moreover, the liquid deposit 68 has a larger opening area on the side of the pump chamber 5 than on the side of the screw 67, which makes it easier for the air in the liquid flowing inside the pump chamber 5 to proceed to the second liquid inlet 62 upon passing by the liquid deposit 68.

Referring to the fourth embodiment described above, only one of the communication holes 16 and 17 may be provided on the fluid path forming member 10, and a portion corresponding to the fluid path forming member 10 may be integrally formed with the case body 3. Also, the number of the first liquid inlet 61 communicating with the reserve tank 6 and the second liquid inlet 62 communicating with the pump chamber 5 is not limited to only one each, but two or more of either may be provided.

Figure 16C:
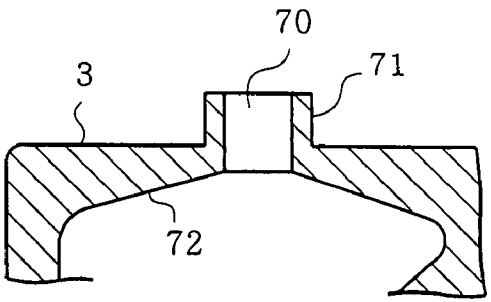
FIGS. 16B and 16C are cross-sectional views taken along the lines 16B-16B and 16C-16C of FIG. 16A, respectively.
Figure 16B:
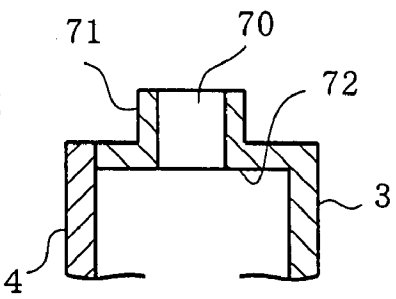
Figure 16A:
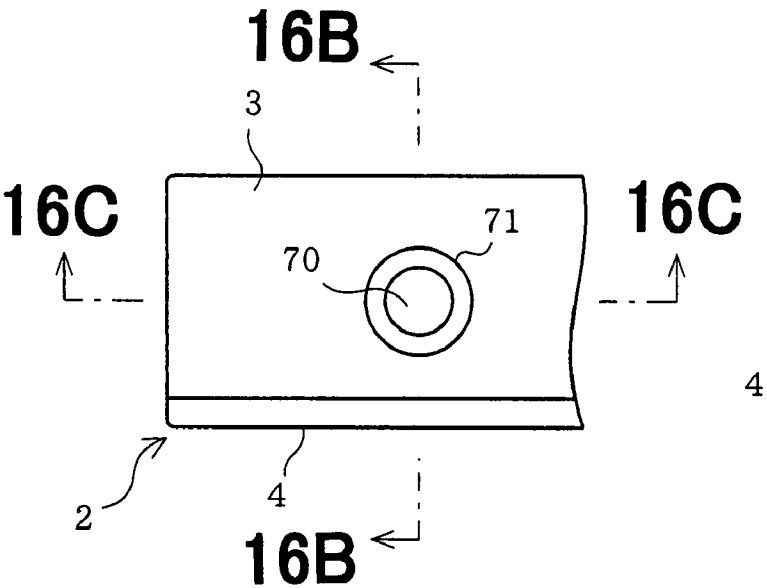
FIG. 16A is a plan view showing a first modification example of the first liquid inlet.

FIGS. 16A to 16C depict a first modification example of the first liquid inlet communicating with the reserve tank 6. The first modification example is different from the fourth embodiment in the following aspect. A first liquid inlet 70 includes a cylindrical portion 71 protruding outward from an outer surface of the case body 3, and can be sealed by placing a cap (not shown) on the cylindrical portion 71. Also, an upper inner wall 72 (the inner wall extending toward both sides of the first liquid inlet 70) is inclined upward toward the first liquid inlet 70, when the first liquid inlet 70 is located at an upper position.

Figure 17C:
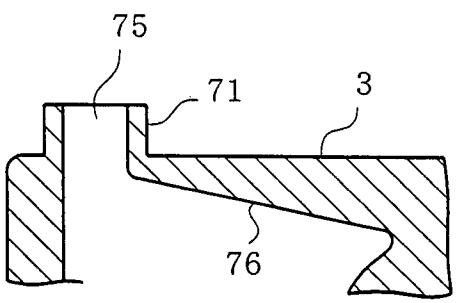
FIG. 17C is a cross-sectional view showing a fourth modification example of the first liquid inlet.
Figure 17B:
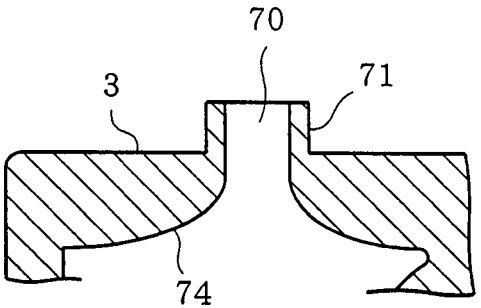
FIG. 17B is a cross-sectional view showing a third modification example of the first liquid inlet.
Figure 17A:
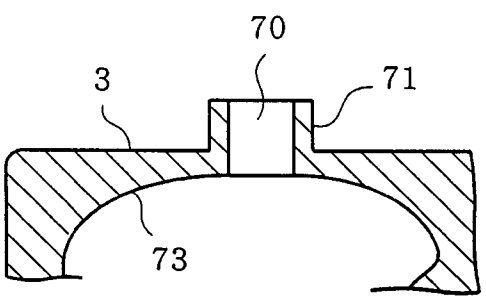
FIG. 17A is a cross-sectional view showing a second modification example of the first liquid inlet.

FIGS. 17A to 17C depict a second to a fourth modification examples of the first liquid inlet communicating with the reserve tank 6, each of which is different from the first modification example in the following aspect. In the second modification example according to FIG. 17A, an upper inner wall 73 of the reserve tank 6 is configured in an arc-shape slope receding upward, when the first liquid inlet 70 is located at an upper position.

In the third modification example according to FIG. 17B, an upper inner wall 74 of the reserve tank 6 is configured in an arc-shape slope protruding toward an inner region of the reserve tank 6, when the first liquid inlet 70 is located at an upper position.

In the fourth modification example according to FIG. 17C, the first liquid inlet 75 is located at a left corner of the case body 3, and the right portion inner wall 76 of the upper inner wall of the reserve tank 6 is inclined upward toward the first liquid inlet 75.

All of the first to the fourth modification examples provide similar advantageous effects as the foregoing fourth embodiment.

The present invention is not limited to the foregoing description, but various modifications or expansions may be made.

To cite a few examples, the rotor 31 of the motor 22 for driving the impeller 26 may be located outside the pump chamber 5.

Also, the suction path 12 may be integrally formed with the case body 3, so that the fluid path forming member 10 only includes the discharge path 13.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

We claim:

1. A fluid pump comprising:

a case including a pump chamber for storing a liquid;

a suction port and a discharge port provided on the case so as to communicate with the pump chamber;

an impeller having pump vanes and rotatably placed in the pump chamber, which suctions a liquid into the pump chamber via the suction port and discharges the liquid out of the pump chamber via the discharge port by rotation;

a motor for driving the impeller, installed in the case and having a stator and a rotor to which the impeller is integrally attached for rotating together;

a reserve tank for storing spare liquid that is provided within the case but outside and independent of the pump chamber;

a fluid path forming member arranged inside the reserve tank, including a discharge path communicating between the discharge port and the pump chamber, the fluid path forming member having a side; and a communication hole which is formed in the side of the fluid path forming member and positioned such that the communication hole faces an inside of the reserve tank of the fluid path forming member so that the communication hole communicates between the discharge path and the inside of the reserve tank, the communication hole being sized so that air in the pump chamber is allowed to flow therethrough into the reserve tank.

2. The fluid pump according to claim 1, wherein a plurality of communication holes are provided on a plurality of faces of the wall constituting the discharge path of the fluid path forming member.

3. The fluid pump according to claim 2, wherein the discharge path is inclined in the reserve tank, and the plurality of communication holes are located at different positions along a longitudinal direction of the discharge path.

4. The fluid pump according to claim 1, further comprising a first liquid inlet communicating inside and outside of the reserve tank, and a second liquid inlet communicating inside and outside of the pump chamber.

5. The fluid pump according to claim 4, wherein the second liquid inlet is provided with a sealing member that seals the second liquid inlet from the outside, such that a liquid deposit is defined between a tip portion of the sealing member and the pump chamber.

6. The fluid pump according to claim 5, wherein the liquid deposit has a larger opening area on the side of the pump chamber than on the side of the sealing member.

7. The fluid pump according to claim 1, further comprising a liquid inlet communicating inside and outside of the reserve tank, wherein an upper inner wall of the reserve tank is inclined upward toward the liquid inlet, when the case is oriented such that the liquid inlet is located at an upper position.

8. The fluid pump according to claim 1, wherein the motor for driving the impeller can be rotated in both forward and backward directions.

9. A cooling system that cools a heat-generating part, comprising:

a heat-receiving section for receiving heat of the heat-generating part via a liquid containing a liquid refrigerant;

a heat-dissipating section for dissipating the heat of the liquid; and a fluid pump for cooling the heat-generating part by circulating the liquid through the heat-receiving section and the heat-dissipating section comprising a case including:

a pump chamber for storing a liquid;

a suction port and a discharge port provided on the case so as to communicate with the pump chamber;

an impeller having pump vanes and rotatably placed in the pump chamber, which suctions a liquid into the pump chamber via the suction port and discharges the liquid out of the pump chamber via the discharge port by rotation;

a motor for driving the impeller, installed in the case and having a stator and a rotor to which the impeller is integrally attached for rotating together;

a reserve tank for storing spare liquid that is provided within the case but outside and independent of the pump chamber;

a fluid path forming member arranged inside the reserve tank, including a discharge path communicating between the discharge port and the pump chamber, the fluid path forming member having a side; and a communication hole which is formed in the side of the fluid path forming member and positioned such that the communication hole faces an inside of the reserve tank of the fluid path forming member so that the communication hole communicates between the discharge path and the inside of the reserve tank, the communication hole being sized so that ir in the pump chamber is allowed to flow therethrough into the reserve tank.

10. The cooling system according to claim 9, wherein a plurality of communication holes are provided on a plurality of different faces of the wall constituting the discharge path of the fluid path forming member.

11. The cooling system according to claim 10, wherein the discharge path is inclined in the reserve tank, and the plurality of communication holes are located at different positions along a longitudinal direction of the discharge path.

12. The cooling system according to claim 9, further comprising a first liquid inlet communicating inside and outside of the reserve tank, and a second liquid inlet communicating inside and outside of the pump chamber.

13. The cooling system according to claim 9, wherein the second liquid inlet is provided with a sealing member that seals the second liquid inlet from the outside, such that a liquid deposit is defined between a tip portion of the sealing member and the pump chamber.

14. The cooling system according to claim 13, wherein the liquid deposit has a larger opening area on the side of the pump chamber than on the side of the sealing member.

15. The cooling system according to claim 9, further comprising a liquid inlet communicating inside and outside of the reserve tank, wherein an upper inner wall of the reserve tank is inclined upward toward the liquid inlet, when the case is oriented such that the liquid inlet is located at an upper position.

16. The cooling system according to claim 9, wherein the motor for driving the impeller can be rotated in both forward and backward directions.

17. The cooling system according to claim 9, wherein the fluid pump and the heat-receiving section are integrally constructed.

18. An electrical appliance including a cooling system that cools a heat-generating part, comprising a fluid pump for circulating a cooling liquid of the cooling system so as to cool the heat-generating part, comprising:

a case including a pump chamber for storing a liquid;

a suction port and a discharge port provided on the case so as to communicate with the pump chamber;

an impeller having pump vanes and rotatably placed in the pump chamber, which suctions a liquid into the pump chamber via the suction port and discharges the liquid out of the pump chamber via the discharge port by rotation;

a motor for driving the impeller, installed in the case and having a stator and a rotor to which the impeller is integrally attached for rotating together;

a reserve tank for storing spare liquid that is provided within the case but outside and independent of the pump chamber;

a fluid path forming member arranged inside the reserve tank, including a discharge path communicating between the discharge port and the pump chamber, the fluid path forming member having a side; and a communication hole which is formed in the side of the fluid path forming member and positioned such that the communication hole faces an inside of the reserve tank of the fluid path forming member so that the communication hole communicates between the discharge path and the inside of the reserve tank, the communication hole being sized so that air in the pump chamber is allowed to flow therethrough into the reserve tank.

19. The electrical appliance according to claim 18, wherein a plurality of communication holes are provided on a plurality of faces of the wall constituting the discharge path of the fluid path forming member.

20. The electrical appliance according to claim 19, wherein the discharge path is inclined in the reserve tank, and the plurality of communication holes are located at different positions along a longitudinal direction of the discharge path.

21. The electrical appliance according to claim 18, further comprising a first liquid inlet communicating inside and outside of the reserve tank, and a second liquid inlet communicating inside and outside of the pump chamber.

22. The electrical appliance according to claim 21, wherein the second liquid inlet is provided with a sealing member that seals the second liquid inlet from the outside, such that a liquid deposit is defined between a tip portion of the sealing member and the pump chamber.

23. The electrical appliance according to claim 22, wherein the liquid deposit has a larger opening area on the side of the pump chamber than on the side of the sealing member.

24. The electrical appliance according to claim 18, further comprising a liquid inlet communicating inside and outside of the reserve tank, wherein an upper inner wall of the reserve tank is inclined upward toward the liquid inlet, when the case is oriented such that the liquid inlet is located at an upper position.

25. The electrical appliance according to claim 18, wherein the motor for driving the impeller can be rotated in both forward and backward directions.

26. The electrical appliance according to claim 18, wherein the fluid pump and the heat-receiving section are integrally constructed.

* * * * *